US006166326A

United States Patent [19]

Nakajima

[11] Patent Number: 6,166,326

[45] Date of Patent: Dec. 26, 2000

[54] METAL CABLE

[75] Inventor: Yoshikatsu Nakajima, Tokyo, Japan

[73] Assignees: Nakajima Tsushinki Kogyo Co., Ltd.; Nishiura Wire Co., Ltd., both of Japan

[21] Appl. No.: 09/253,575

[22] Filed: Feb. 19, 1999

[30] Foreign Application Priority Data

Dec. 1, 1998 [JP] Japan ..... 10-341379

[51] Int. Cl.[7] ..... H01B 11/06

[52] U.S. Cl. ..... 174/36

[58] Field of Search ..... 174/36, 107, 109, 174/117 F; 138/110, 128, 166

[56] References Cited

U.S. PATENT DOCUMENTS

| | | | |
|---|---|---|---|
| 3,439,111 | 4/1969 | Miracle et al. | 174/107 |
| 3,662,090 | 5/1972 | Grey | 174/36 X |
| 4,413,656 | 11/1983 | Pithouse | 138/110 |
| 4,477,693 | 10/1984 | Krabec et al. | 174/36 |
| 4,533,784 | 8/1985 | Olyphant, Jr. | 174/36 |

FOREIGN PATENT DOCUMENTS

| | | |
|---|---|---|
| 48-99475 | 11/1973 | Japan . |
| wo 94/09498 | 10/1973 | WIPO . |

OTHER PUBLICATIONS

Laid–open Japanese patent publication No. 55–117813, pp. 57–60 (Japanese language) (1980).

*Primary Examiner*—Kristine Kincaid
*Assistant Examiner*—Chau N. Nguyen
*Attorney, Agent, or Firm*—Klarquist Sparkman Campbell Leigh & Whinston, LLP

[57] ABSTRACT

A metal cable includes at least one center conductor, an internal insulator provided around the center conductor, a tape enclosure formed by a tape having an aluminum foil layer and a plastic layer laminated thereon, and an external insulating coating provided on the outer circumference of the tape enclosure. The width of the tape of the tape enclosure is wider than those of hitherto used tapes and larger than the length of the outer circumference of the internal insulator. In order to form the tape enclosure, the tape is longitudinally wrapped closely around the internal insulator with the aluminum foil layer being inside the plastic layer and with one edge portion of the tape not directly contacting the internal insulator and the aluminum foil portions of both extra edges not participating in wrapping are then forced against each other to form a fin-shaped extra portion which is then folded double and further folded onto that portion of the tape enclosure itself which has been already closely contacting the internal insulator. With the above construction of the tape enclosure, even if the cable is subjected to bending or twisting force, the bound portion of the tape enclosure is surely prevented from being separated, thereby avoiding losses of shielding effect with great reliability.

6 Claims, 4 Drawing Sheets

METAL CABLE

BACKGROUND OF THE INVENTION

This invention relates to a metal cable or coaxial lead-in cable including at least one center conductor made of a metallic material, an internal insulator provided around the center conductor, a tape enclosure whose tape has a transverse width larger than the length of the outer circumference of the internal insulator and consists of an aluminum foil layer and a plastic layer laminated thereon, the tape being longitudinally wrapped closely around the internal insulator with the aluminum foil layer being inside the plastic layer, and an external insulating coating provided on the outer circumference of the tape enclosure.

Such a metal cable, and particularly a coaxial lead-in cable of the kind mentioned in the opening paragraph have been typically used for connecting terminals to a multiple digital network in telecommunication service. The metal cable in a communication line is required to have good communication characteristic and shielding property for avoiding the signal leakage and noise disturbance. In the multiple digital network, particularly, it is required for cables to have extremely high communication characteristic and shielding property. With the coaxial lead-in cables, more particularly, the good communication characteristic and shielding property are very important. Moreover, the coaxial cables to be used for connection of terminals are needed to have a construction capable of being freely bent, and therefore the external conductor must be flexible maintaining their shielding property.

In order to ensure the high shielding property and communication characteristic, aluminum pipes may be used as shielding members or external conductors, but they are disadvantageously poor in flexibility. In a hitherto used shielded metal cable or coaxial lead-in cable, therefore, as shown in FIG. 1*a* a tape 4 having a transverse width larger than the length of the outer circumference of an internal insulator 3 provided around a center conductor 2 and consisting of an aluminum foil layer 4*a* and a plastic layer 4*b* laminated thereon is longitudinally wrapped closely around the internal insulator 3 with the aluminum foil layer 4*a* being inside the plastic layer 4*b*. With this shielded metal cable, one edge portion 4A is overlapped on the other edge portion 4B, these edge portions 4A and 4B corresponding to the longer portions of the tape than the length of the outer circumference of the internal insulator 3, thereby forming a shielding member or an outer conductor around which is covered by an external insulating coating 5.

With the shielded metal cable or coaxial cable of the prior art as shown in FIG. 1*a*, however, this shielding member or external conductor as the tape enclosure is poor in high frequency shielding effect, because the aluminum foil layers at the overlapped tape edges do not contact with each other. Moreover, when this cable is subjected to bending or twisting, the bound portion of the tape tends to separate to lose the high frequency shielding effect with high probability. Such a reduction or loss in high frequency shielding effect will cause noise disturbance and signal leakage. With the digital signals different from the analog signals, slight noise disturbance and signal leakage will give rise to very serious damage to the associated telecommunication system.

Moreover, with another shielded metal cable or coaxial lead-in cable hitherto used, as shown in FIG. 1*b*, when a tape is wrapped closely around an internal insulator, aluminum foil portions of both the extra edges 6A and 6B not participating in wrapping are forced against each other to form a fin-shaped extra portion which is then folded upon the tape itself already closely contacting the internal insulator to form an overlapped portion thereon.

This coaxial lead-in cable of the prior art shown in FIG. 1*b* has been improved to keep the inner aluminum foil layers of the edge portions of the tape in contact with each other. However, as this contacting portion has no resistance to tensile forces generated when the cable is subjected to bending or twisting, there will be a risk of the contacting portion being separated.

SUMMARY OF THE INVENTION

It is an object of the invention to provide a shielded metal cable or coaxial lead-in cable having a shielding member or external conductor formed by a tape, which involves no risk of the tape being separated and no risk of reduction or loss in shielding effect.

In order to accomplish this object, the metal cable according to the invention is so constructed that the width of the tape forming the tape enclosure is wider than those of hitherto used tapes, and the tape enclosure comprises an overlapped portion which is formed in a manner that the tape is wrapped closely around the internal insulator with one edge portion of the tape not directly contacting the internal insulator, and the aluminum foil portions of both extra edges of the tape not participating in wrapping are forced against each other to form a fin-shaped extra portion which is then folded double and further folded onto that portion of said tape enclosure itself which has been already closely contacting the internal insulator.

According to the invention, the aluminum foil layers of the fin-shaped extra portion of the tape enclosure are in close contact with each other to ensure the continuity of the aluminum foil layers.

Moreover, after the fin shaped extra portion is folded double, it is further folded onto that portion of the tape enclosure which has been already closely contacting the internal insulator to form the overlapped portion, thereby surely preventing the tape enclosure from being separated when the cable is subjected to bending or twisting force, and hence avoiding the loss of screening or shielding effect with great certainty.

The invention will be more fully understood by referring to the following detailed specification and claims taken in connection with the appended drawings.

DESCRIPTION OF THE PREFERRED EMBODIMENTS

Figure 2B:
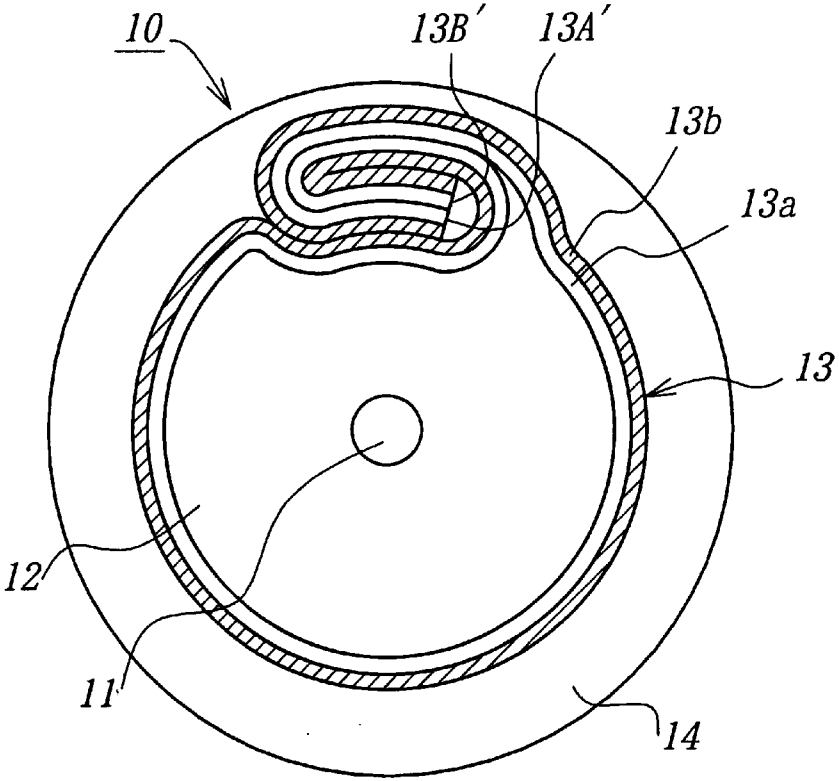
FIG. 2*b* is a schematic sectional view of the shielded metal cable or coaxial lead-in cable illustrating the external conductor having an overlapped portion formed in a manner that the fin-shaped extra portion shown in FIG. 2*a* is folded double and then the doubled fin-shaped extra portion is folded onto the tape itself already closely contacting the internal insulator.
Figure 2A:
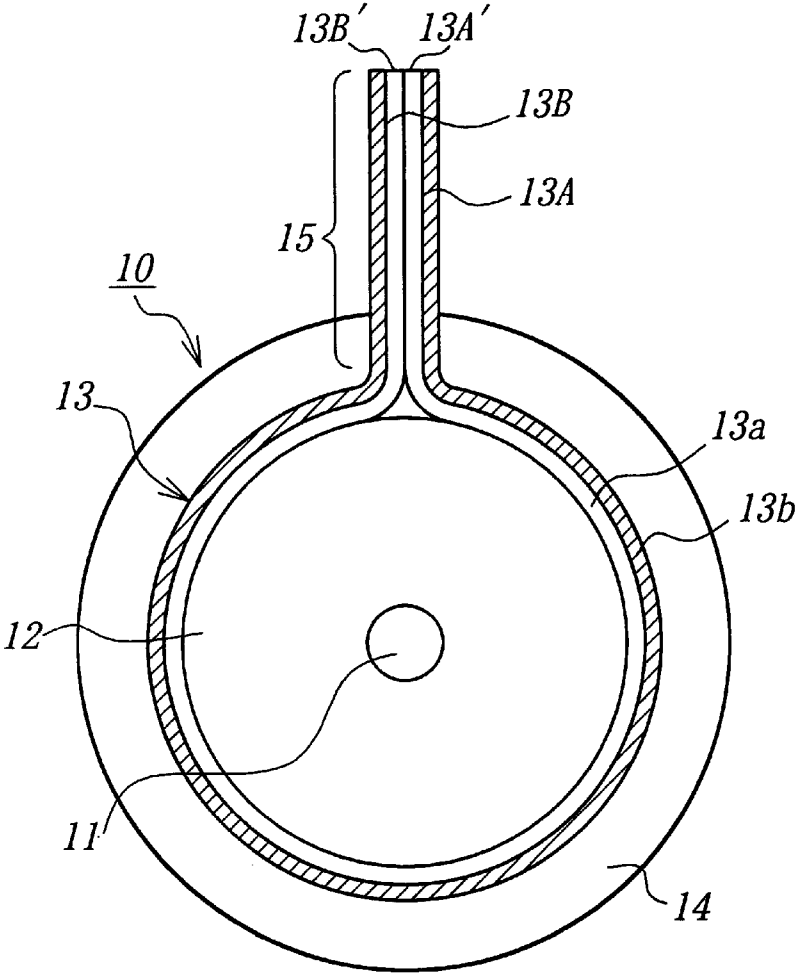
FIG. 2*a* is a schematic sectional view of a shielded metal cable or coaxial lead-in cable of a preferred embodiment according to the invention illustrating a tape longitudinally closely wrapped around an internal insulator to form a fin-shaped extra portion formed by extra edge portions substantially equal in length.

FIGS. 2*a* and 2*b* illustrate a metal cable or coaxial lead-in cable 10 of a preferred embodiment according to the invention. This metal cable or coaxial lead-in cable 10 comprises at least one center conductor (core) 11 (although only one is shown in the illustrated embodiment, a plurality of center conductors may be provided) made of a metallic material, an internal insulator 12 provided around the center conductor 11, a tape enclosure 13 formed by a tape having a transverse width larger than the length of the outer circumference of the internal insulator 12 and consisting of an aluminum foil layer 13*a* and a plastic layer 13*b* laminated thereon (the plastic layer 13*b* being cross-hatched for clarity in FIGS. 2*a* and 2*b*), and an external insulating coating 14 provided on the outer circumference of the tape enclosure 13. The tape is longitudinally wrapped closely around the internal insulator 12 with the aluminum foil layer 13*a* being inside the plastic layer 13*b* to form the tape enclosure 13. The tape enclosure 13 may function only as a shielding material for shielding the center conductor 11, or may also function as an external conductor in a coaxial cable.

Figure 1B:
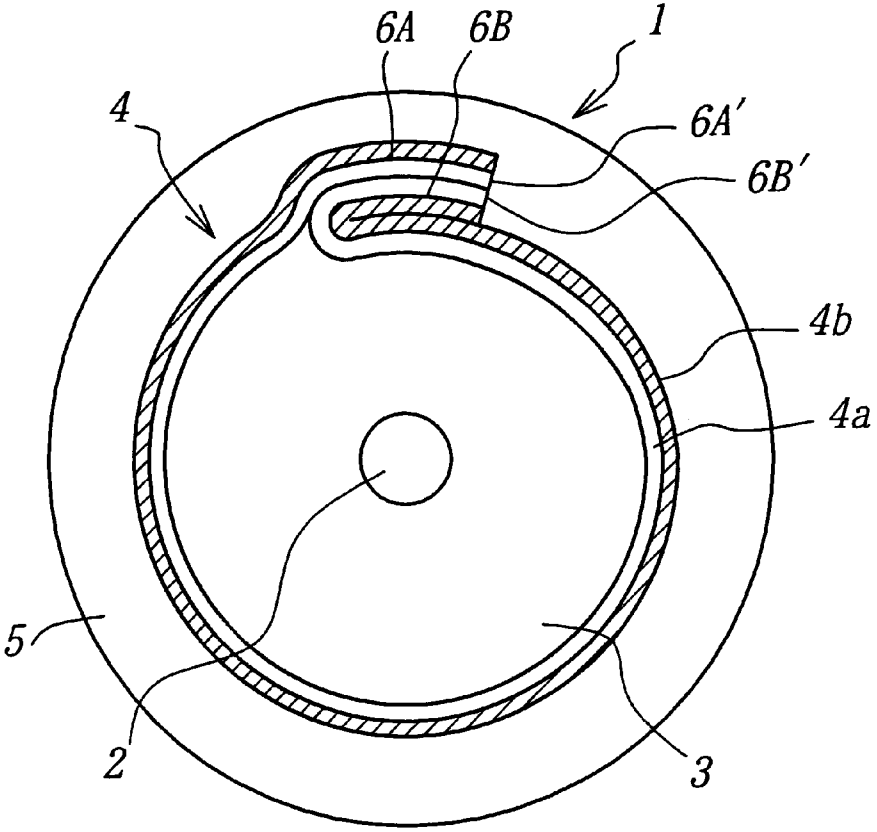
FIG. 1b PRIOR ART
FIG. 1*b* is a schematic sectional view of a shielded metal cable or coaxial lead-in cable of the prior art showing the external conductor formed by a tape which is longitudinally wrapped closely around the internal insulator in a manner that aluminum foil portions of both the extra edges not participating in the wrapping are forced against each other to form a fin-shaped extra portion which is then folded on the tape itself already closely contacting the internal insulator to form an overlapped portion thereon.
Figure 1A:
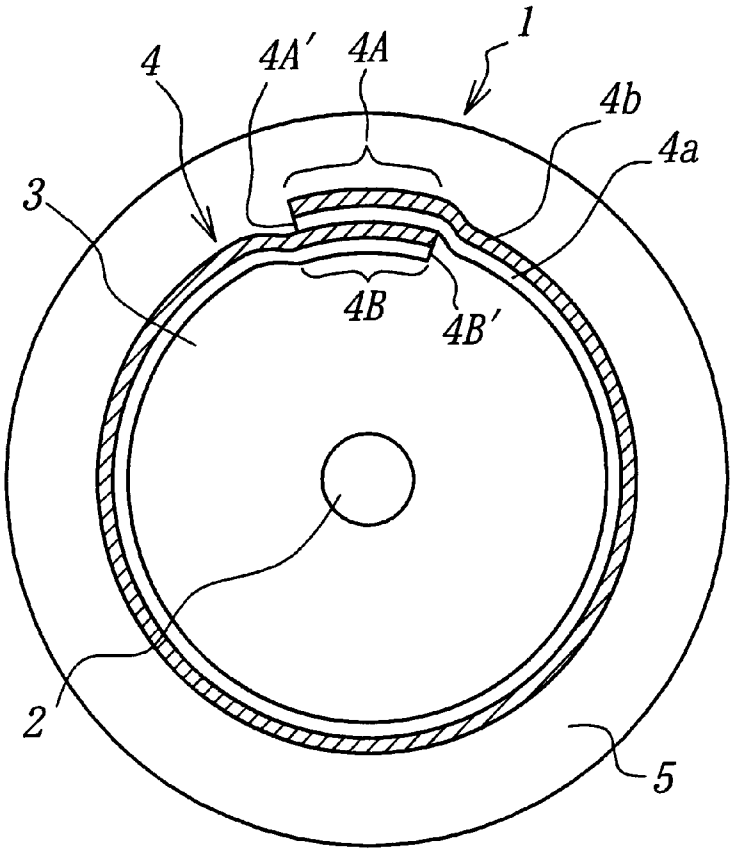
FIG. 1a PRIOR ART
FIG. 1*a* is a schematic sectional view of a shielded metal cable or coaxial lead-in cable of the prior art showing the external conductor formed by a tape which is longitudinally wrapped around the internal insulator in a manner that one edge portion of the tape is overlapped on the other edge portion directly contacting the internal insulator.

In the metal cable or coaxial lead-in cable 10 according to the present invention, the tape of the tape enclosure 13 has a width wider than those of hitherto used tapes and is wrapped closely around the entire circumference of the internal insulator such that one edge portion of the tape is not brought into direct contact with the internal insulator. (One edge portion 4B of the tape of the prior art as shown in FIG. 1*a* is in direct contact with the internal insulator.) The aluminum foil parts 13*a* of the extra edge portions 13A and 13B on both the edges of the tape not participating in wrapping are forced against each other to form a fin-shaped extra portion 15, the portions 13A and 13B having ends 13A' and 13B', respectively, as shown in FIG. 2*a*. Thereafter, the fin-shaped extra portion 15 is folded double and further folded onto the tape enclosure itself already closely contacting the internal insulator to form a laminated overlapped portion thereon as shown in FIG. 2*b*.

In the metal cable or coaxial lead-in cable 10 of the embodiment shown in FIG. 2, particularly, the extra edge portions 13A and 13B are equal in length extending from the internal insulator 12 (FIG. 2*a*) and the fin-shaped extra portion 15 is folded double into half length and further folded onto the tape enclosure itself already closely contacting the internal insulator 12 to form the overlapped portion (FIG. 2*b*). The distance through which the extra edge portions extend from the internal insulator is referred to as a "length" in this specification, although it is part of the width of the tape.

Figure 3B:
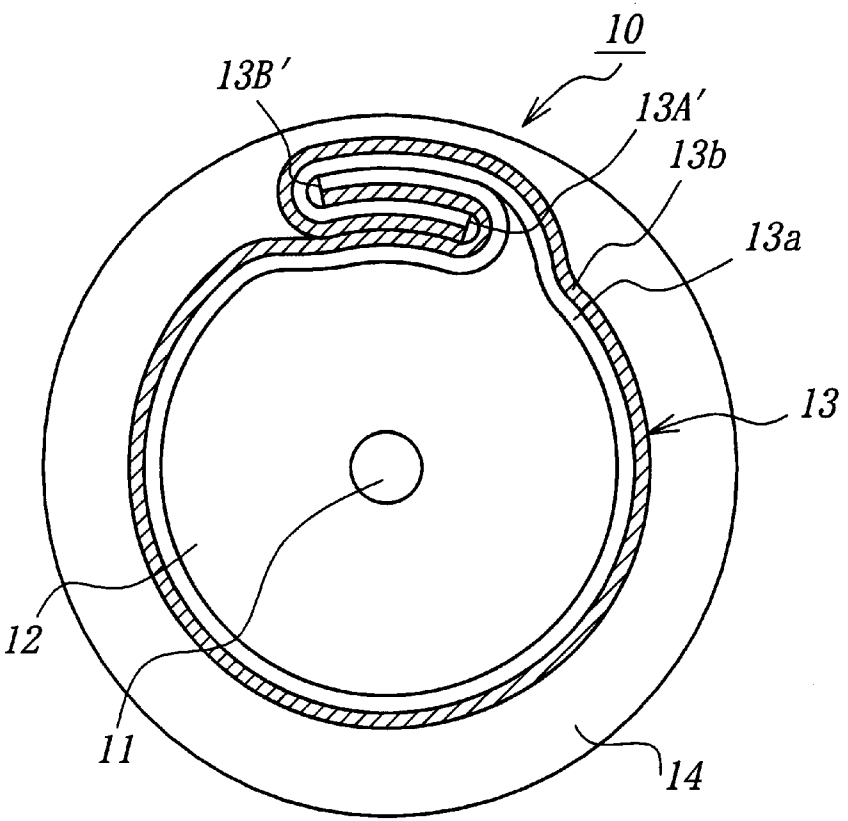
FIG. 3*b* is a schematic sectional view of the shielded metal cable or coaxial lead-in cable illustrating the external conductor having an overlapped portion formed in a manner that the fin-shaped extra portion shown in FIG. 3*a* is folded double and then the doubled fin-shaped extra portion is folded onto the tape itself already closely contacting the internal insulator; and, FIG. 4 is a partly removed perspective view of a shielded coaxial lead-in cable of a further embodiment according to the invention.
Figure 3A:
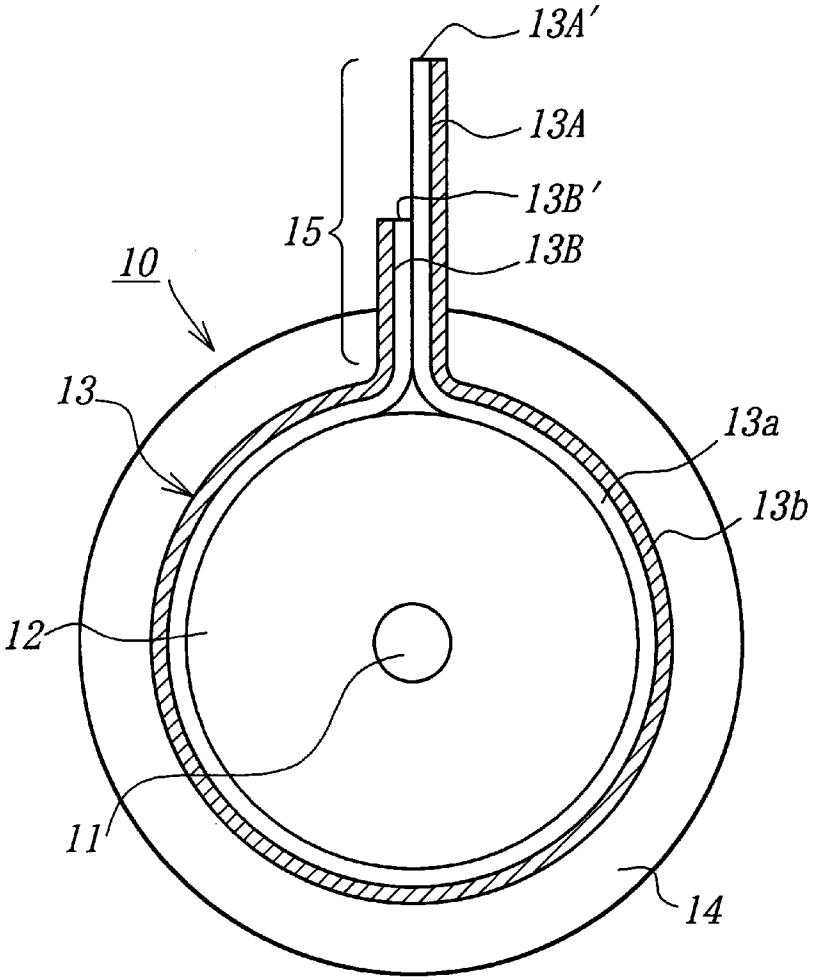
FIG. 3*a* is a schematic sectional view of a shielded metal cable or coaxial lead-in cable of another preferred embodiment according to the invention illustrating a tape longitudinally closely wrapped around an internal insulator to form a fin-shaped extra portion formed by extra edge portions, one being substantially twice as long as the other.

FIGS. 3*a* and 3*b* illustrate another preferred embodiment of the invention. (The plastic layer 13*b* is cross-hatched for clarity in FIGS. 3*a* and 3*b*.). In the metal cable or coaxial lead-in cable 10 of this embodiment, a tape is closely wrapped around an internal insulator 12 such that one extra edge portion 13A, having an end 13A' is substantially twice as long as the other extra edge portion 13B having an end 13B' (FIG. 3*a*). The longer extra edge portion 13A is then folded double to enclose the shorter extra edge portion 13B to form a fin-shaped extra portion having a length substantially half of the initial longer extra edge portion 13A before being folded. Then the fin-shaped extra portion enclosing the shorter extra edge portion 13B therein is folded onto the tape enclosure itself already closely contacting the internal insulator 12 to form a laminated overlapped portion thereon (FIG. 3*b*).

In the illustrated embodiments, the tapes are shown in exaggerated thickness so that the overlapped portions are shown in extremely raised forms. However, the actually used tapes are very thin so that their wrapped contours whose folded extra edges have been folded onto themselves are substantially circular in cross-section along the outer circumference of the internal insulator, having no raised folded portions.

Figure 4:
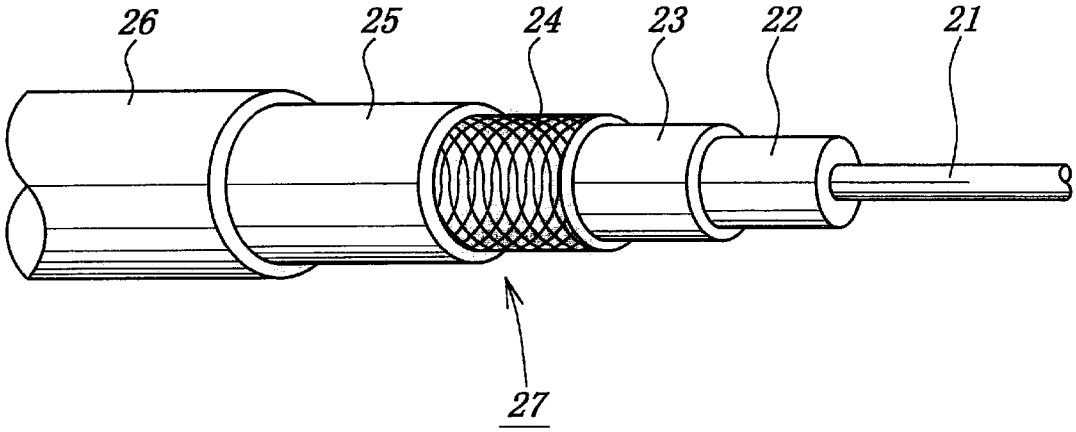

In an embodiment shown in FIG. 4, a shielded coaxial lead-in cable 27 comprises a center conductor 21, an internal insulator 22 on the center conductor 21, an external conductor 23 constructed by the above tape enclosure according to the invention around the internal insulator 22, a metal braided member 24, a tape enclosure 25 similar to the above tape enclosure as a shielding material, and an external insulating coating 26.

In the metal cable or coaxial lead-in cable according to the invention, as a tape for forming the tape enclosure has a width wider than those of hitherto used tapes, and when the tape is wrapped closely around the internal insulator, one edge portion of the tape is not brought into direct contact with the internal insulator and aluminum foil portions of both extra edges of the tape are forced against each other to form a fin-shaped extra portion which is then folded double and further folded onto that portion of the tape enclosure itself which has been already closely contacting the internal insulator to form the overlapped portion, thereby ensuring the continuity of the aluminum foil layers to prevent the reduction in shielding effect.

According to the invention, moreover, after the fin shaped extra portion is folded double, it is further folded onto that portion of the tape enclosure which has been already closely contacting the internal insulator to form the overlapped portion, thereby surely preventing the tape enclosure from being separated when the cable is subjected to bending or twisting force, and hence avoiding the loss of screening or shielding effect with great certainty.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A metal cable comprising at least one center conductor made of a metallic, material, an internal insulator provided around said center conductor, a tape enclosure comprising a tape having a transverse width larger than the length of the outer circumference of the internal insulator, the tape comprising an aluminum foil layer and a plastic layer laminated thereto, the tape being longitudinally wrapped closely around the internal insulator with the aluminum foil layer being inside the plastic layer, and an external insulating coating provided on the outer circumference of the wrapped tape enclosure, wherein the tape comprises a portion wrapped closely around the internal insulator over the entire circumference thereof and a pair of extra overlapped portions having end edges, the extra overlapped portions not directly contacting the internal insulator, the aluminum foil layer of each the extra overlapped portions being forced against each other to form a fin-shaped extra portion, the fin-shaped extra portion being then folded double onto the plastic layer of the portion of the tape wrapped closely around the internal insulator, whereby the end edges of the extra overlapped portions of the tape are confined by the plastic layer of the portion of the tape wrapped closely around the internal insulator.

2. The metal cable as set forth in claim 1, wherein said tape enclosure is constructed to serve as a shielding member for shielding said center conductor.

3. The metal cable as set forth in claim 1, wherein said tape enclosure is constructed to serve as an external conductor outside said center conductor of a coaxial cable.

4. The metal cable as set forth in claim 1, wherein said tape enclosure is constructed to serve as a shielding member for shielding both the center conductor and an external conductor of a coaxial cable.

5. The metal cable of claim 1, wherein the pair of extra overlapped portions are substantially equal in length, and the fin-shaped extra portion is folded into half length and then further folded onto the portion of the tape wrapped closely around the internal insulator.

6. The metal cable of claim 1, wherein one of the pair of extra overlapped portions is substantially twice the length of the other of the pair, and the one of the pair is then folded into half length to enclose the other of the pair and form the fin-shaped extra portion, and the fin-shaped extra portion enclosing the other of the pair is further-folded onto the portion of the tape wrapped closely around the internal insulator.

* * * * *